US006295410B1

(12) United States Patent
Helms et al.

(10) Patent No.: US 6,295,410 B1
(45) Date of Patent: Sep. 25, 2001

(54) PUSHBUTTON HAND DRYER TIMER AND METHOD

(75) Inventors: Valerie Helms, Baxter; James D. Livers, Jr., Cookeville, both of TN (US)

(73) Assignee: France/Scott Fetzer Company, Fairview, TN (US)

( * ) Notice: Subject to any disclaimer, the term of this patent is extended or adjusted under 35 U.S.C. 154(b) by 0 days.

(21) Appl. No.: 09/499,130

(22) Filed: Feb. 7, 2000

(51) Int. Cl.[7] ..... F26B 23/04; F24H 3/00; H01H 43/00

(52) U.S. Cl. ..... 392/381; 219/492; 219/507; 34/563; 200/38 R; 200/38 A

(58) Field of Search ..... 392/381, 380, 392/370; 34/563, 564, 90, 202; 219/492, 493, 507, 509; 200/38 R, 38 A, 38 F, 38 FA, 38 FB, 38 B, 38 BA, 38 C, 38 CA, 38 E, 39 R, 39 A

(56) References Cited

U.S. PATENT DOCUMENTS

| | | | | |
|---|---|---|---|---|
| 1,419,712 | | 6/1922 | Bassette . | |
| 1,423,800 | | 7/1922 | Hibbard et al. . | |
| 1,578,047 | | 3/1926 | Lum . | |
| 2,777,934 | * | 1/1957 | Falkenthal | 392/380 |
| 2,837,835 | * | 6/1958 | Hewitt et al. | 392/381 |
| 3,942,265 | | 3/1976 | Sisler et al. . | |
| 4,642,907 | | 2/1987 | Best . | |
| 4,653,201 | | 3/1987 | Seaman . | |
| 4,683,369 | | 7/1987 | Rieckman et al. . | |
| 5,107,603 | | 4/1992 | Durazzani . | |
| 5,351,417 | | 10/1994 | Rubin . | |
| 5,442,867 | * | 8/1995 | Robinson | 34/90 |
| 5,568,691 | | 10/1996 | Rubin . | |
| 6,137,067 | * | 10/2000 | Helms et al. | 200/38 R |

* cited by examiner

*Primary Examiner*—John A. Jeffery
(74) *Attorney, Agent, or Firm*—Wood, Herron & Evans, L.L.P.

(57) ABSTRACT

A hand dryer timer having a switch in electrical communication with, and controlling the operation of a heater, a fan motor and a timer motor which are electrically connected to two nonneutral lines of a power source. A cam is mounted on a drive shaft of the timer motor such that the cam rotates with the drive shaft and also slides longitudinally over the drive shaft. The cam has a cam lobe adjacent an actuating arm of the switch. A biasing element is located between the timer motor and the cam and biases the cam to a first position aligning the cam lobe with the actuating arm of the switch. The switch includes two sets of switch contacts in a power circuit for the heater and fan motor, so that at the end of a drying cycle, the two sets of switch contacts are effective to electrically isolate the heater and fan motor from both non-neutral lines of the power source.

15 Claims, 3 Drawing Sheets

PUSHBUTTON HAND DRYER TIMER AND METHOD

FIELD OF THE INVENTION

This invention relates generally to the field of appliance controls and, more particularly, to an improved pushbutton hand dryer timer.

BACKGROUND OF THE INVENTION

Timing mechanisms have been utilized for decades in the control of many different appliances. The present invention relates generally to electric dryers, and more particularly to a pushbutton hand dryer of the type commonly found in public rest rooms. With such a hand dryer, a user pushes a button or knob to start a drying cycle. During the drying cycle, a timing motor, a heater and a fan are turned on; and at the end of a drying cycle, as determined by the timing motor, the timing motor, heater and fan are automatically turned off. Such dryers must be simple, rugged and durable in construction and operate with great reliability over a long service life. To achieve such features, the hand dryer should have the fewest possible parts that operate in the simplest possible way.

As shown in FIG. 6, with known timer circuits, the heater H and fan motor FM are connected to the two non-neutral lines L1, L2 of a 220 volt ("V") source by a single switch S1. When the switch S1 is open, one side of each of the heater H and fan motor FM is disconnected from one of the non-neutral lines L1; however, the other side of each of the heater H and fan motor FM remain connected to the other of the non-neutral lines L2. Therefore, any inadvertent electrical contact of the one side of the heater and/or fan motor to a ground, for example, the metal dryer housing or base etc., will result in 120 being applied thereto. Thus, the heater H and/or fan motor FM will be operated at half power. Such an inadvertent electrical contact with ground can result from a frayed, nicked or broken wire or other conductor accidently contacting a neutral or ground potential.

Therefore, there is a need to better isolate the heater and fan motor from the non-neutral wires of a power source.

SUMMARY OF THE INVENTION

The present invention provides an improved pushbutton hand dryer that reduces the probability of any inadvertent or uncommanded operation of the heater and fan motor. The improved pushbutton hand dryer reduces the chances that a frayed, nicked or broken wire or other electrical malfunction will result in the heater or fan motor operating at a reduced voltage. More specifically, the improved pushbutton hand dryer of the present invention provides an improved electrical isolation between the heater and fan motor and the non-neutral lines of a power source. Therefore, present invention has the advantage of providing a pushbutton hand dryer that operates more reliably with a longer service life.

In accordance with the principles of the present invention and in accordance with the described embodiments, the present invention provides a hand dryer operable with first and second nonneutral power wires having a voltage potential therebetween. The hand dryer includes a heater, fan motor and timer motor all rated to operate at the voltage potential. A first switch is operated by the timer motor and has a first side electrically connected to the heater and fan motor and an opposite side electrically connected to the timer motor and the first nonneutral power wire. A second switch is operated by the timer motor and has a first side electrically connected to the heater and the fan and timer motors and an opposite side electrically connected to the second nonneutral power wire.

In one aspect of the invention, the first switch includes first switch contacts that connect and disconnect the heater and fan motor respectively to and from the first nonneutral power wire, and the second switch includes switch contacts that connect and disconnect the heater and fan and timer motors respectively to and from the second nonneutral power wire. Thus, with two switches, the isolation of the heater and fan motor from the nonneutral wires is improved over hand dryers using only a single switch.

In a further embodiment of the invention, the first switch has an actuating arm switching a state of first electrical contacts at a consistent repeatable first time in response to operation of the timer motor, and the second switch has an actuating arm switching a state of second electrical contacts at a consistent repeatable second time in response to operation of the timer motor.

In one aspect of this further embodiment, the actuating arms are mechanically connected such that motion of the actuating arms causes the first switch to switch prior to the switching of the second switch. Therefore, the heater and fan motor will always be disconnected from the power source prior to disconnecting the timer motor, and both switches will always operate.

In another embodiment, the invention provides a method of operating a hand dryer in which a timer motor has a cam lobe initially engaged with an actuating arm of the first and second switches, thereby causing switch contacts to electrically disconnect the heater, fan motor and timer motor from the power source. The cam lobe is then disengaged from the actuating arm, thereby causing the first and second switches to electrically connect the heater, the fan motor and the timer motor to first and second nonneutral wires of the power source. Thereafter the timer motor moves the cam lobe into engagement with the actuating arm to operate the first switch and electrically disconnect the heater and fan motor from the first nonneutral wire. After that, the timer motor continues to move the cam lobe and actuating arm, thereby operating the second switch to electrically disconnect the timer motor, heater and fan motor from the second nonneutral wire.

These and other objects and advantages of the present invention will become more readily apparent during the following detailed description together with the drawings herein.

DETAILED DESCRIPTION OF THE INVENTION

Figure 1:
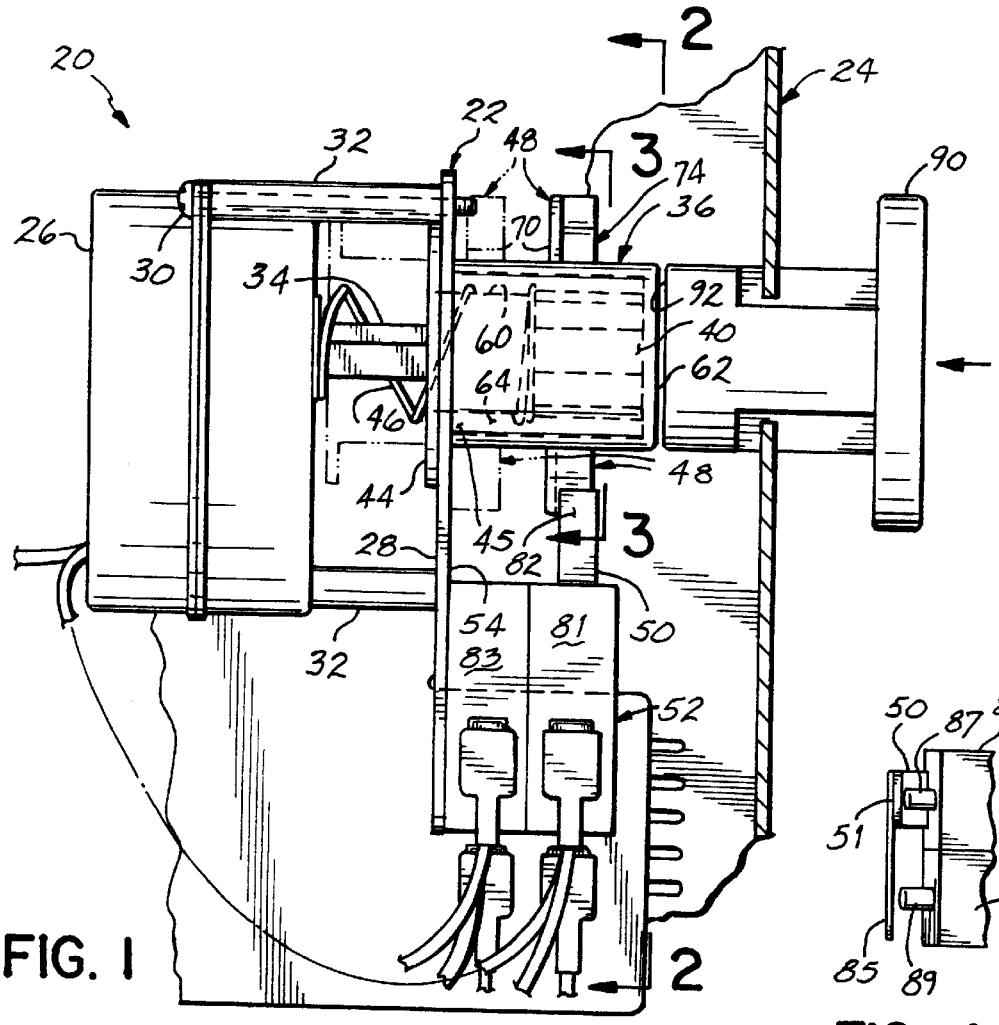
FIG. 1 is a side elevation view of the timer assembly in accordance with the principles of the present invention.
Figure 2:
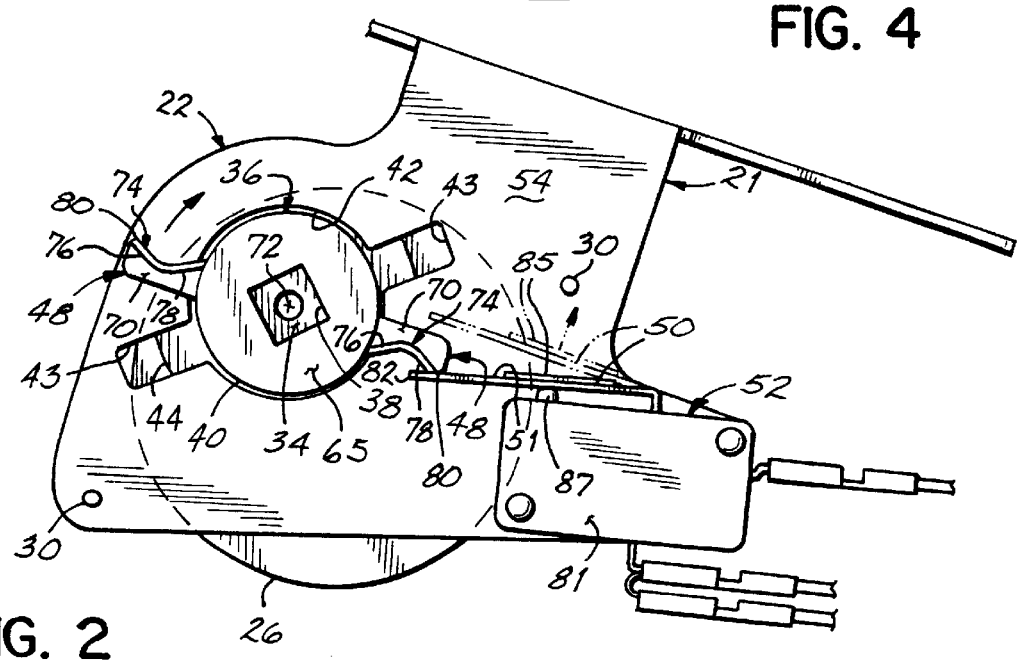
FIG. 2 is a front elevation view of the timer assembly taken along line 2—2 of FIG. 1.

Referring to FIG. 1, a timer assembly 20 includes a bracket 21 (FIG. 2) that includes a mounting or support plate 22. The mounting bracket 21 is attached in a known manner within a pushbutton hand dryer 24. A timing motor 26 of a known construction is mounted to the inner side 28 of the support plate 22 by means of threaded fasteners 30. The fasteners 30 may be threaded into the plate 22 or pass through the plate 22 and secured by nuts (not shown). To maintain the timer motor 26 at a desired distance from the inner side 28 of the support plate 22, the threaded fasteners 30 pass through tubular sleeves 32 of equal length. The motor 26 has an output or drive shaft 34 that preferably has a noncircular cross-sectional profile as shown in FIG. 2.

A cam 36 includes a central longitudinal bore 38 having a noncircular cross-sectional profile similar to that of the output shaft 34, so that the cam 36 can be slidably mounted on the output shaft 34. Thus, any rotation of the output shaft 34 is transmitted directly to the cam 36; however, the cam 36 can slide longitudinally along the output shaft 34. The cam 36 has a main body portion 40 that is cylindrical in shape and extends through a clearance hole 42 (FIG. 2) in the mounting plate 22. The clearance hole 42 includes diametrically opposed slots 43 that permit cam lobes 48 to pass through the support plate 22. A flange 44 is mounted at an inner end 45 of the cam 36 and is larger than the clearance hole 42, thereby restraining the inner end 45 of the cam 36 from fully passing through the clearance hole 42. The flange 44 is pushed or biased against an inner surface 28 of the mounting plate 22 by biasing element, for example, a compression spring 46 thereby defining a first or outermost position of the cam 36. In that outermost position, diametrically opposed cam lobes 48 on the cam 36 are aligned to contact or engage an actuating arm 50 of a first microswitch 52. The microswitch 52 is mounted to the outer side 54 of the mounting plate 22.

Figure 3:
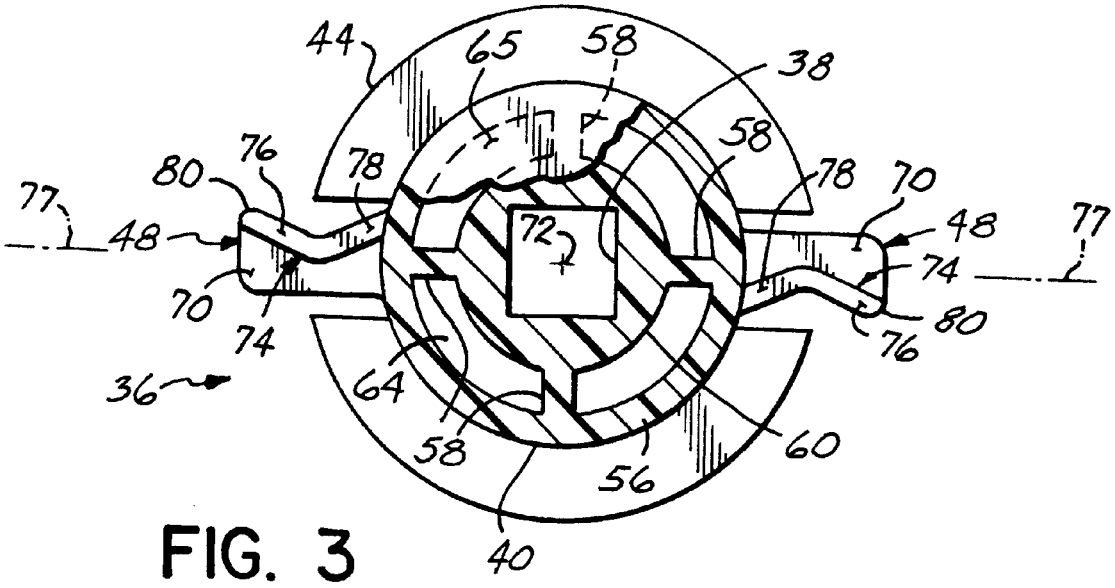
FIG. 3 is a cross-sectional view taken generally along line 3—3 of FIG. 1.

Referring to FIG. 3, the body portion 40 of the cam 36 includes peripheral tubular wall 56 that is connected by means of ribs 58 with a central tubular member 60 that includes the central longitudinal bore 38. The interconnecting ribs 58 extend from an outer end 62 (FIG. 1) of the cam 36 longitudinally through the cam 36 to approximately the location of the cam lobes 48. An annular opening 64 is formed within the cam 36 between the cylindrical inner surface of the peripheral wall 56 and the cylindrical inner surface of the inner tubular member 60. The compression spring 46 is normally sized to be received within the annular opening 64 within the cam 36. A top wall 65 located at the outer end 62 of the cam 36 covers the annular opening 64.

The cam lobes 48 are generally L-shaped, and each lobe 48 has a lower leg or wall member 70 that is in a plane generally perpendicular to the longitudinal centerline 72 of the cam 36 and generally parallel to the plate 22. The wall members 70 strengthen the respective cam lobes 48. Further, each of the L-shaped cam lobes 48 has a side wall 74 extending substantially perpendicularly along a forward edge of the bottom wall 70 toward the outer end 62 of the cam 36. Thus, the side wall 74 is generally perpendicular to the mounting plate 22. As viewed from the outer end 62 of the cam 36, the side wall 74 is curved and has a nonlinear cross-sectional profile in a plane perpendicular to the longitudinal centerline 72 of the cam 36 and generally parallel to the mounting plate 22. The side wall 74 of each cam lobe 48 is formed by an inner side wall section 78 and an outer side wall section 76. The inner side wall 78 preferably forms an included angle of approximately 21° with a line 77 bisecting the cam lobes 48 in a plane parallel to the plate 22. The outer side wall 76 preferably forms an included angle of approximately 23° with the line 77 bisecting the cam lobes 48 in a plane parallel to the plate 22. Further, a straight line passing through the distal end 80 of the outer side wall section 76 and the point at which the inner side wall section 78 joins the body portion 40 of the cam 36 does not pass through the centerline 72 of the cam 36.

Figure 4:
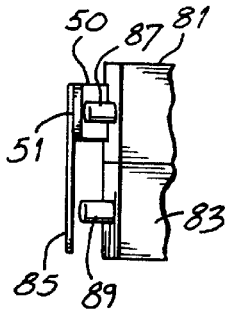
FIG. 4 is an end view of the microswitch illustrating the operation of the two switch modules.
Figure 5:
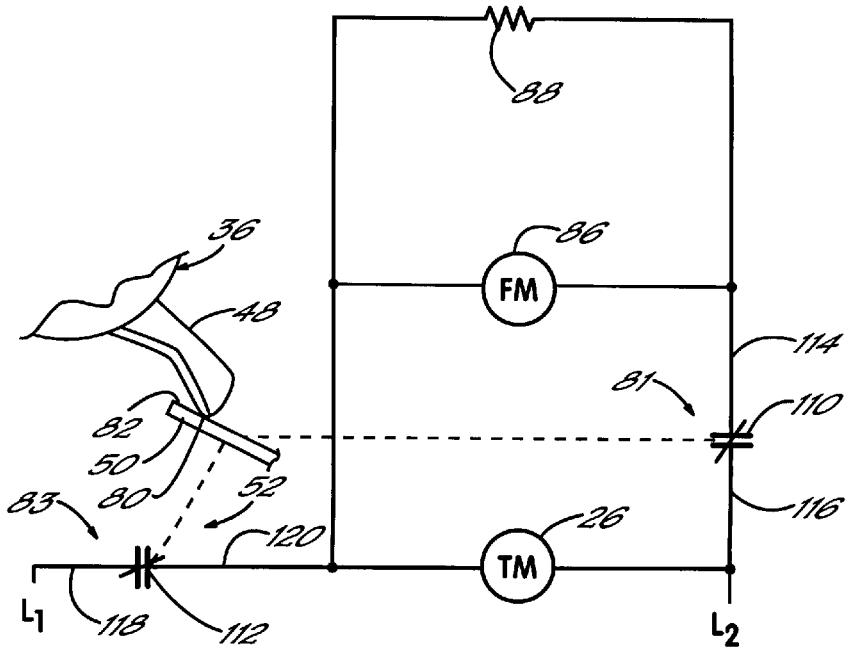
FIG. 5 is a schematic circuit diagram of a pushbutton hand timer circuit in accordance with the principles of the present invention.
Figure 6:
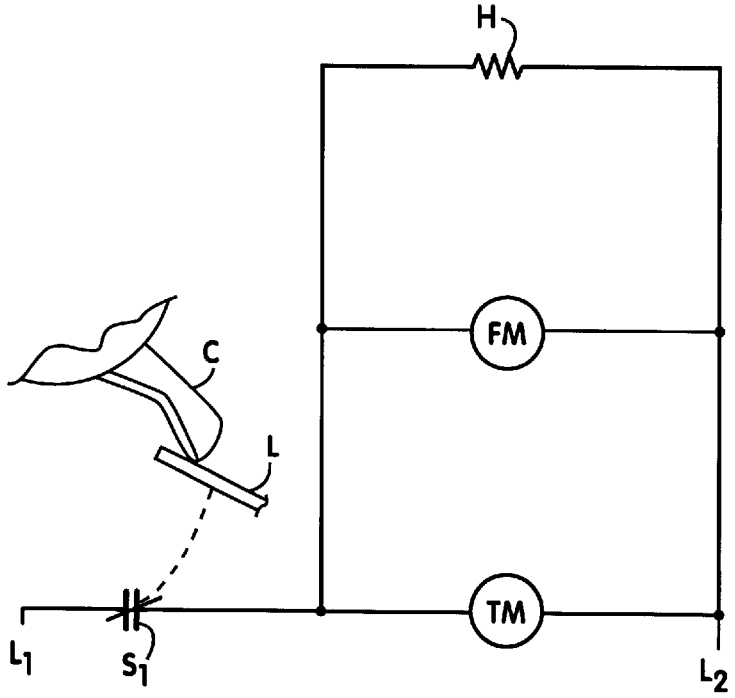
FIG. 6 PRIOR ART
FIG. 6 is a schematic circuit diagram of a known pushbutton hand timer circuit.

Referring to FIGS. 2 and 4, the microswitch 52 is comprised of a first switch module 81 and a second switch module 83. The first switch module 81 has an actuating arm 50 that extends over a switch actuating button 87. The switch module contacts 110 (FIG. 5) change state in response to the actuating arm 50 depressing the button 87. The actuating arm 50 has a second actuating arm or paddle 85 rigidly connected to outer directed side 51 of the actuating arm 50 and is thus offset slightly from the arm 50. The second arm 85 extends over a switch actuating button 89 for the second switch module 83. Thus, motion of the actuating arm 50 and the paddle 85 depresses the button 89 causing the contacts 112 of the second switch module 83 to change state. It should be noted that the second arm 85 is rigidly attached to an outer side 51 the arm 50, and hence, the arm 50 contacts the button 87 prior to the arm portion 85 contacting the button 89. Therefore, as the actuating arm 50 and arm portion 85 are moved, the button 87 is consistently pushed prior to the button 89; and the contacts 110 consistently change state prior to the contacts 112 changing state.

Referring to FIG. 4, the switch module 81 includes normally closed contacts 110, and switch module 83 includes normally closed contacts 112. One side 114 of the normally closed contacts 110 is connected to a first side or a first power connection of each of the fan motor 86 and heater 88. The opposite side 116 of the contacts 110 is connected to one side or a first power connection of the timer motor 26 and the non-neutral line L2. The other non-neutral line L1 is connected to one side 118 of the contacts 112, and the other side 120 of the contacts 112 is connected to the other side or second power connection of each of the timer motor 26, the fan motor 86, and the heater 88.

In use, in its quiescent or nonoperating state, referring to FIG. 2, the distal end 80 of an outer wall section 76 of one of the cam lobes 48 is in contact with a distal end 82 of the actuator arm 50 of the microswitch 52. Further, the distal end 80 of the cam lobe 48 is applying sufficient pressure on the actuator arm 50 so as to actuate the switch modules 81, 83 and hold the normally closed contacts 110, 112 of FIG. 4 in their open state. With the contacts 110, 112 open, power cannot be applied to the timer motor 26, fan motor 86 and heater 88; and the timer motor 26, fan motor 86 and heater 88 remain off. To operate the hand dryer 24, a user depresses or pushes the knob or pushbutton 90 (FIG. 1) of the hand dryer 24. The inner end 92 of the knob 90 contacts the outer end 62 of the cam 36 and moves the cam 36 to the left, as viewed in FIG. 1, over the shaft 34 of the timer motor 26 to a second position illustrated in phantom. As the cam 36 is moved along the output shaft 34 toward its second position, the cam lobe 48 disengages and loses contact with the actuator arm 50 of the switch 52. After losing contact with the cam lobe 48, the actuating arm 50 and its paddle 85 are then free to pivot to a second position illustrated in phantom in FIG. 2. Upon the user releasing the pushbutton 90, the cam 36 is returned by the biasing spring 34 to its original, first position as illustrated in FIG. 1. Normally, the pushbutton 90 is mounted in the hand dryer 24 with its own return spring. Referring to FIG. 2, the unique shape of the side wall 74 of the cam lobe 48 reduces the potential for, and preferably eliminates interference between the cam lobe 48 and the actuator arm 50 as the cam 36 returns to its original position.

After the cam 36 loses contact with and releases the actuator arm 50, the actuator arm 50 and its paddle 85 pivot to the position shown in phantom in FIG. 2, thereby changing the state of the switch modules 81, 83, and referring to FIG. 4, closing the normally closed contacts 110, 112. Closing the contacts 110, 112 initiates a drying cycle by applying power to the timer motor 26, the fan motor 86 and the heater 88, thereby turning those devices on. Turning the timer motor 26 on causes the output shaft 34 and cam 36 to rotate in a clockwise direction as illustrated in FIG. 2. The timer motor 26, fan motor 86 and heater 88 continue to operate until rotation of the timer motor 26 causes the distal end 80 of a cam lobe 48 to again contact and depress, or move, the actuating arm 50 of the microswitch 52.

With the present invention, the actuating button 87 of the switch module 81 is mechanically connected to the contacts 110, and the actuating button 89 is mechanically connected to the contacts 112. The relative positions of the arms 50, 85 cause the actuating arm 50 to predictably and repeatably initially depress button 87 and first pickup, that is, open, the normally-closed contacts 110. Opening the contacts 110 electrically disconnects one side of the fan motor 86 and heater 88 from one of the non-neutral leads L2 of the power source. However, the timer motor 26 continues to run until the actuating arm portion 85 depresses the button 89 causing the normally-closed contacts 112 to consistently and predictably open after the opening of the contacts 110. Opening the contacts 112 electrically disconnects the timing motor 26, fan motor 86 and heater from the other non-neutral lead L1 of the power source. Thus, the switch 52 is effective to electrically disconnect the fan motor 86 and heater 88 from both non-neutral leads L1 and L2 of the power source.

The output shaft 34 of the timer motor 26 rotates at an angular velocity such that a drying cycle of a desired duration is achieved during one-half of a full rotation of the output shaft 34. Thus, the cam 36 contains two diametrically opposed cam lobes 48 and provides two full drying cycles for each rotation of the output shaft 34 and the cam 36. As will be appreciated, the number of cam lobes 48 on the cam 36 may be changed to conform to different angular velocities of the output shaft 34 and different desired time periods for the drying cycle.

The hand dryer timer described with respect to FIGS. 1–4 provides a substantial improvement over prior timer assembly designs. First, the timing motor circuit completely isolates the fan motor and heater from the non-neutral leads of the power source. Hence, in the event that the circuit through some failure becomes inadvertently connected to a neutral or grounded component, for example, the frame 21 or the metal housing 24, no voltage will be applied to the fan motor 86 or heater 88. Thus, the probability that the fan motor 86 or heater 88 will inadvertently be turned on is remote.

While the invention has been set forth by a description of the one embodiment in considerable detail, it is not intended to restrict or in any way limit the claims to such detail. Additional advantages and modifications will readily appear to those who are skilled in the art. For example, in the described embodiment, the main body 40 of the cam 36 is cylindrical and the cam lobes 48 extend radially therefrom; however, as will be appreciated, the cam 36 can have other shapes such as a multilateral shapes or even noncircular shapes in which the cam lobes 48 are mostly or fully integrated within the main body 40 of the cam 36. As will be appreciated, the successful operation of the present invention is independent of the lower wall 70 on the cam lobes 48, and therefore, the low wall 70 may be eliminated. The cam 36 is preferably injection molded from a glass reinforced 66 nylon material commercially available as "ZYTEL" 70G 33L nylon material from Du Pont Corporation. However, the cam 36 may be made from other materials consistent with the desired performance specifications. Further, while the cam 36 is preferably molded of a plastic material as shown herein, the cam 36 may have many other configurations, for example, a solid part, and may be made of other materials such as metal, ceramic, a fiber composition, etc.

As described herein, the noncircular cross-sectional profiles of the shaft 34 and bore 38 are multilateral, for example, square, triangular, hexagonal, etc. Alternatively, the noncircular cross-sectional profiles of the output shaft 34 and bore 38 may be elliptical, star-shaped, splined, etc. Further, as shown, the cross-sectional profile of the output shaft 34 and bore 38 are noncircular. Those cross-sectional profiles may be circular but interconnected such that the cam 36 rotates with the shaft 34 and is able to slide longitudinally with respect to the shaft 34. Such mechanical interconnections are well known and include, for example, a slot and key or simply a diametric pin extending through the cam and a longitudinal slot in the output shaft 34.

In the described embodiment, the cam 36 is slidably mounted directly on the drive shaft 34 of the timer motor 26. However, as will be appreciated, the drive shaft 34 can be a spline or similar shaft, and the cam 36 slidably and rotationally mounted independent of the drive shaft 34. The flange 44 of the cam 36 can also be formed with peripheral gear teeth that mesh with the spline or an intervening gear. Thus, the cam 36 can be mounted independent of the drive shaft 34 but be driven rotationally by the drive shaft spline and also slide longitudinally to operate identically to the cam assembly described herein.

In the described embodiment, the compression spring 46 extends into an annular opening 64 within the cam 36. Alternatively, the compression spring 46 may be sized such that it does not fit within the annular opening 64. In that embodiment, the inner end of the cam 36 may be molded with a protruding boss on which the spring 46 may be located.

Further, the timer assembly herein is part of a pushbutton hand dryer timer; however, as will be appreciated, hand dryers as used herein often have an adjustable output duct allowing the drying air to be directed to areas other than the hands, for example, the face and hair. The dryer timer assembly of the present invention is applicable to any "hand dryer" type of dryer which is manually turned on and automatically turns off, thereby operating in an identical or similar fashion to the hand dryer described herein.

As earlier described, the contacts 110 should consistently and predictably open before the contacts 112. While the use of an offset actuating arm paddle 85 is one way of providing that capability, any other switch or mechanism for operating the switch that achieves the same result is consistent with the claimed invention. Further, if it is possible to provide a switch 52 in which the contacts 110 and 112 consistently and predictably open simultaneously, such a switch may be used in place of the switch described herein to practice the claimed invention. In addition, as will be appreciated, while the motors are connected to the 220 volts source, the motors may be rated at 120 volts and operated with a dropping resistor or other voltage dropping device.

Therefore, the invention in its broadest aspects is not limited to the specific detail shown and described. Consequently, departures may be made from the details described herein without departing from the spirit and scope of the claims which follow.

What is claimed is:

1. A hand dryer operable with first and second nonneutral power wires having a voltage potential therebetween, the hand dryer comprising:

a heater operatively connected to the voltage potential;

a fan motor operatively connected to the voltage potential;

a timer motor operatively connected to the voltage potential;

a first switch operated by the timer motor having a first side electrically connected to the heater and fan motor and an opposite side electrically connected to the timer motor and the first nonneutral power wire; and a second switch operated by the timer motor and having a first side electrically connected to the heater and the fan and timer motor and an opposite side electrically connected to the second nonneutral power wire.

2. A hand dryer of claim 1 wherein the first switch comprises first switch contacts having a first state connecting the heater and fan motor to the first nonneutral power wire and a second state disconnecting the heater and fan motor from the first nonneutral power wire.

3. A hand dryer of claim 1 wherein the second switch comprises second switch contacts having a first state connecting the heater and fan and timer motor to the second nonneutral power wire and a second state disconnecting the heater and fan and timer motor from the second nonneutral power wire.

4. A hand dryer of claim 1 wherein the voltage potential is approximately 240 volts.

5. A hand dryer operable with first and second nonneutral power wires having a voltage potential therebetween, the hand dryer comprising:

a heater operatively connected to the voltage potential and having first and second power connections;

a fan motor operatively connected to the voltage potential and having first and second power connections;

a timer motor having a cam and operatively connected to the voltage potential, the timer motor having first and second power connections;

a first switch having a first contact in electrical communication with the first power connections of the heater and the fan motor and a second contact in electrical communication with the first power connection of the timer motor and the first nonneutral power wire, the first switch being mechanically operated by the timer motor and having a first state placing the first and second contacts of the first switch in electrical communication in response to operation of the hand dryer being initiated, and the first switch having a second state interrupting the electrical communication between the first and second contacts of the first switch in response to the cam on the timer motor actuating the first switch; and a second switch having a first contact in electrical communication with the second power connections of the heater and the fan and timer motors and a second contact in electrical communication with the second nonneutral power wire, the second switch being mechanically operated by the timer motor and having a first state placing the first and second contacts of the second switch in electrical communication in response to operation of the hand dryer being initiated, and the second switch having a second state interrupting the electrical communication between the first and second contacts of the second switch in response to continued operation of the timer motor after the cam actuates the first switch, the operation of the heater and timer and fan motors being started in response to the first and second switches being in the first state, the operation of the heater and fan motor being terminated in response to the first switch being in the second state and the second switch being in the first state, and the operation of the timer motor being terminated in response to the first and second switches being in the second state.

6. A hand dryer of claim 5 wherein the first and second contacts of the first switch is a pair of normally-closed contacts.

7. A hand dryer of claim 5 wherein the first and second contacts of the second switch is a pair of normally-closed contacts.

8. A hand dryer of claim 5 wherein the voltage potential is approximately 240 volts.

9. A hand dryer operable with first and second nonneutral power wires having a voltage potential therebetween, the hand dryer comprising:

a heater electrically connected to the nonneutral power wires and rated to operate at approximately the voltage potential;

a fan motor electrically connected to the nonneutral power wires and rated to operate at approximately the voltage potential;

a timer motor electrically connected to the nonneutral power wires and rated to operate at approximately the voltage potential;

a first switch mechanically operated by the timer motor and electrically connected between one of the nonneutral power wires and the heater and fan motor, the first switch having a first actuating arm switching a state of first electrical contacts at a consistent repeatable first time in response to operation of the timer motor; and a second switch mechanically operated by the timer motor and electrically connected between one of the nonneutral power wires and the fan motor, the second switch having a second actuating arm switching a state of second electrical contacts at a consistent repeatable second time in response to operation of the timer motor.

10. A hand dryer of claim 9 wherein the second actuating arm is connected to the first actuating arm.

11. A hand dryer of claim 10 wherein the second actuating arm switches the state of the second electrical contacts at a consistent repeatable second time in response to motion of the first actuating arm.

12. A hand dryer of claim 11 wherein the first and second actuating arms are mechanically connected such that motion of the actuating arm causes the first switch to switch at the first time prior to the second switch switching at the second time.

13. A method of operating a hand dryer comprising:

providing a timer motor having a drive shaft with a cam lobe mounted thereon, the cam lobe being initially engaged with an actuating arm of first and second switches having contacts electrically disconnecting a heater, fan motor and timer motor from a power source;

disengaging the cam lobe from the actuating arm, thereby causing the first and second switches to electrically connect the heater, the fan motor and the timer motor to first and second nonneutral wires of the power source;

thereafter engaging and moving the actuating arm with the cam lobe to operate the first switch and electrically disconnect the heater and fan motor from the first nonneutral wire; and thereafter continuing to move the actuating arm with the cam lobe to operate the second switch and electrically disconnect the timer motor, heater and fan motor from the second nonneutral wire.

14. A method of operating a hand dryer comprising:

providing a timer motor with a drive shaft having a cam lobe in contact with an actuating arm of first and second switches, the switches having contacts electrically disconnecting a heater, fan motor and the timer motor from a power source;

moving the cam lobe out of engagement with the actuating arm, thereby permitting the actuating arm to move to a position operating the switches and connecting the heater, the fan motor and the timer motor to two nonneutral wires of the power source;

moving the cam lobe into alignment with the cam lobe being rotated by the timer motor; and rotating the cam lobe into contact with the actuating arm, thereby operating the first switch to disconnect the heater and the fan motor from the first nonneutral wire and thereafter operating the second switch to disconnect the heater, the fan motor and the timer motor from the second nonneutral wire.

15. A method of operating a hand dryer comprising:

providing a timer motor having a drive shaft with a cam slidably mounted thereon, the cam placing a cam lobe in contact with an actuating arm of first and second switches having contacts electrically disconnecting a heater, fan motor and the timer motor from a power source;

moving the cam in a first direction to disengage the cam lobe from the actuating arm, thereby permitting the actuating arm to move to a position causing the first and second switches to electrically connect the heater, fan motor and timer motor to first and second nonneutral wires of the power source;

moving the cam in an opposite direction to align the cam lobe with the actuating arm of the switches;

rotating the cam lobe with the timer motor into contact with the actuating arm;

moving the actuating arm with the cam lobe to operate the first switch and electrically disconnect the heater and fan motor from the first nonneutral wire; and continuing to move the actuating arm with the cam lobe to operate the second switch and electrically disconnect the timer motor, heater and fan motor from the second nonneutral wire.

* * * * *